US011751618B2

(12) United States Patent
Reese et al.

(10) Patent No.: US 11,751,618 B2
(45) Date of Patent: Sep. 12, 2023

(54) MEDICAL FACE MASK WITH CLEAR PORTION

(71) Applicant: Prestige Ameritech, Ltd., North Richland Hills, TX (US)

(72) Inventors: Rex D. Reese, North Richland Hills, TX (US); George D. Reese, North Richland Hils, TX (US); Michael L. Bowen, North Richalnd Hills, NY (US)

(73) Assignee: Prestige Ameritech, Ltd., North Richland Hills, TX (US)

( * ) Notice: Subject to any disclaimer, the term of this patent is extended or adjusted under 35 U.S.C. 154(b) by 626 days.

(21) Appl. No.: 15/616,731

(22) Filed: Jun. 7, 2017

(65) Prior Publication Data

US 2018/0007982 A1 Jan. 11, 2018

Related U.S. Application Data

(60) Provisional application No. 62/359,449, filed on Jul. 7, 2016.

(51) Int. Cl.
*A41D 13/00* (2006.01)
*A41D 31/14* (2019.01)
(Continued)

(52) U.S. Cl.
CPC ..... *A41D 31/145* (2019.02); *A41D 13/11* (2013.01); *A41D 13/1115* (2013.01);
(Continued)

(58) Field of Classification Search
CPC .... A41D 13/11; A41D 13/1115; A41D 27/13; A41D 27/24; A41D 27/245; A41D 31/04; A41D 31/14; A41D 31/325; A41D 2300/238; A41D 2300/50; A41D 13/1107; A41D 13/1138; A62B 23/02; A62B 23/025; A62B 18/02; A62B 18/08; A61F 13/00029; A61F 13/00085; A61F 13/126; A61F 13/2005; A61M 16/06
(Continued)

(56) References Cited

U.S. PATENT DOCUMENTS 4,323,063 A * 4/1982 Fisichella ..... A41D 13/1146 128/863
4,825,878 A * 5/1989 Kuntz ..... A41D 13/11 2/9

(Continued)

*Primary Examiner* — Adam Baker
(74) *Attorney, Agent, or Firm* — Betsy Kingsbury Dowd; BKDowd Law, P.C.

(57) ABSTRACT

A facemask includes an air-filtering portion comprising an air-permeable filtering media; a see-through portion in the filtering media; and a layered portion on each opposing side of the see-through portion. The see-through portion is configured so that, in use, a mouth of a wearer is visible therethrough, and is formed from a transparent film covering a void in, and fixed along its periphery to, the filtering media. The film extends across the length of the facemask, including over the void, forming layered portions of film on filtering media on opposing sides of the clear-portion. A method of manufacture includes removing, e.g., kiss-cutting, the air-permeable filtering media away to form the see-through portion, after layering the film onto the filtering media.

22 Claims, 6 Drawing Sheets

(51) Int. Cl.
*A41D 13/11* (2006.01)
*A41H 42/00* (2006.01)

(52) U.S. Cl.
CPC ..... *A41D 31/14* (2019.02); *A41H 42/00* (2013.01); *A41D 2300/52* (2013.01)

(58) Field of Classification Search
USPC ..... 128/863
See application file for complete search history.

(56) References Cited

U.S. PATENT DOCUMENTS 5,561,863 A * 10/1996 Carlson, II ..... A41D 13/1115 128/206.19
5,818,569 A * 10/1998 Berent ..... A61F 9/02 2/452
6,123,077 A 9/2000 Bostock et al.
7,802,572 B2 * 9/2010 Hahne ..... A41D 13/1192 128/857
2003/0192546 A1 * 10/2003 Bostock ..... A41D 13/1138 128/206.19
2006/0144403 A1 * 7/2006 Messier ..... B01D 39/2017 128/206.19
2006/0230485 A1 * 10/2006 Lee ..... A41D 13/1138 2/15
2008/0092897 A1 * 4/2008 Behm ..... A41D 13/11 128/206.12
2011/0308525 A1 * 12/2011 Lu ..... A62B 23/025 128/206.19
2014/0224261 A1 8/2014 Tsuei
2015/0216241 A1 * 8/2015 Lee ..... A41D 13/1192 128/863
2016/0029716 A1 * 2/2016 Duncan ..... A41D 13/11 128/863
2018/0256926 A1 * 9/2018 Kyung ..... A62B 18/088

* cited by examiner

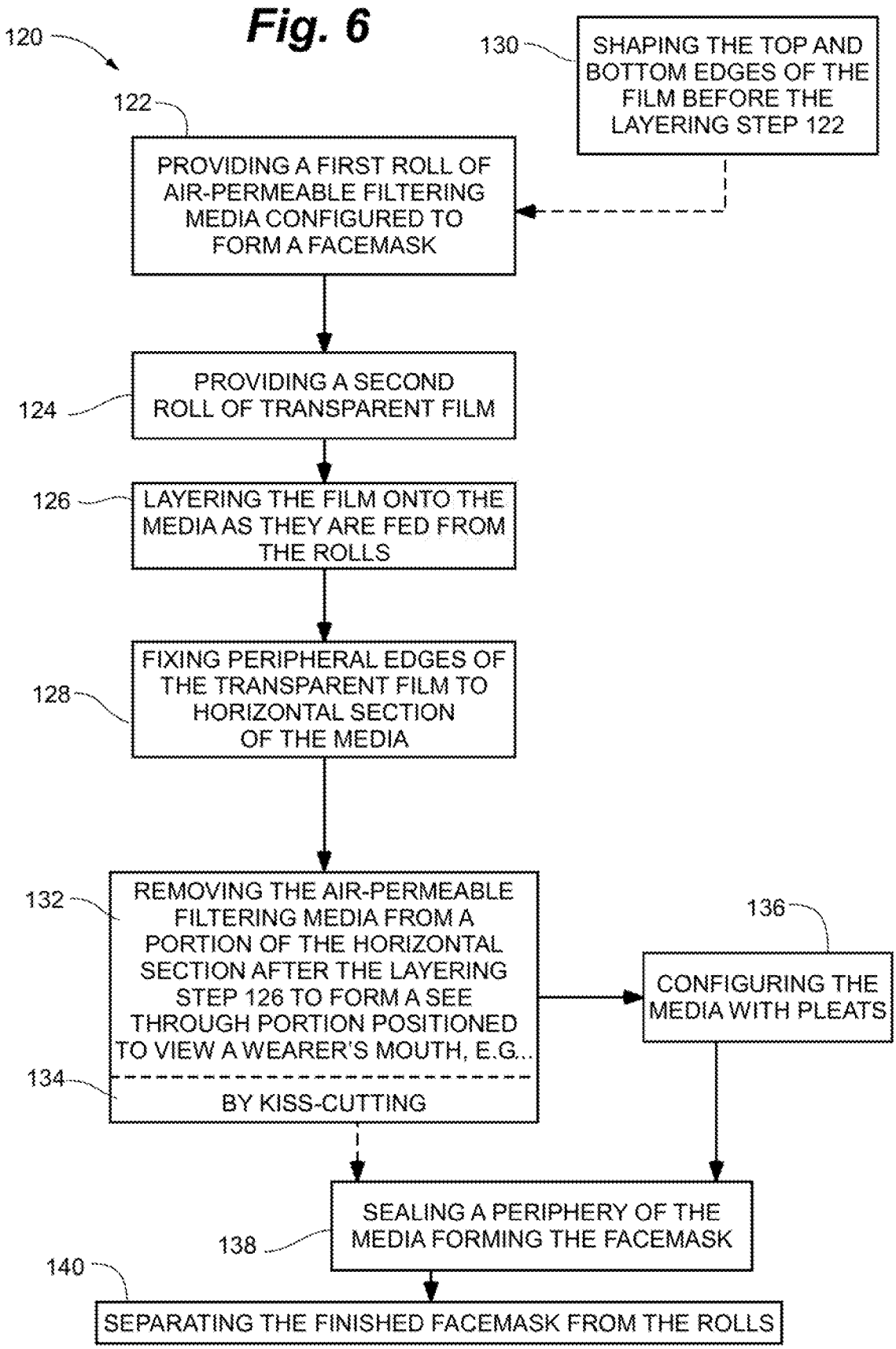
Fig. 6
120
130
SHAPING THE TOP AND BOTTOM EDGES OF THE FILM BEFORE THE LAYERING STEP 122
122
PROVIDING A FIRST ROLL OF AIR-PERMEABLE FILTERING MEDIA CONFIGURED TO FORM A FACEMASK
124
PROVIDING A SECOND ROLL OF TRANSPARENT FILM
126
LAYERING THE FILM ONTO THE MEDIA AS THEY ARE FED FROM THE ROLLS
128
FIXING PERIPHERAL EDGES OF THE TRANSPARENT FILM TO HORIZONTAL SECTION OF THE MEDIA
132
REMOVING THE AIR-PERMEABLE FILTERING MEDIA FROM A PORTION OF THE HORIZONTAL SECTION AFTER THE LAYERING STEP 126 TO FORM A SEE THROUGH PORTION POSITIONED TO VIEW A WEARER'S MOUTH, E.G...
134
BY KISS-CUTTING
136
CONFIGURING THE MEDIA WITH PLEATS
138
SEALING A PERIPHERY OF THE MEDIA FORMING THE FACEMASK
140
SEPARATING THE FINISHED FACEMASK FROM THE ROLLS

MEDICAL FACE MASK WITH CLEAR PORTION

CROSS-REFERENCE TO RELATED APPLICATION

The present disclosure claims priority to U.S. Provisional Patent Ser. No. 62/359,449, filed on Jul. 7, 2016, entitled MEDICAL FACE MASK WITH CLEAR PORTION, the entirety of which is incorporated herein by reference.

FIELD OF DISCLOSURE

The present disclosure relates generally to facemasks and, in particular, to a facemask with a clear see-through portion positioned over the mouth of a wearer during use.

BACKGROUND

Medical facemasks for use by various health care workers, medical personnel, doctors, surgeons, dentists, and so on are well-known in the art. Such facemasks are designed for filtering unwanted particulates, bacteria, and other contaminants, preferably from both inhaled and exhaled air. Such facemasks typically comprise a porous filtering media and may be a multi-layered structure. For example, the air-porous filtering media may include an outer layer of a nonwoven, spunbond material, and an inner, face-side, layer of a nonwoven cellulose or other material that is appropriate for contact with a wearer's face. The air-filtering media protecting the wearer from contaminates may further include intermediate layers which may be electrostatically charged, and/or may contain various antibacterial and/or antiviral agents and the like.

To protect the wearer from inhaling any form of contaminates, including those that may originate from patients or others, inhaled air flow to the mouth and nose must be adequately filtered through the air-permeable filtering media. This has conventionally been achieved by constructing face masks such that the air-permeable filtering media overlies the wearer's nose and mouth. In addition, to avoid unfiltered air from bypassing the air-permeable filtering media, such face masks typically employ a tight seal between the face of a wearer and the periphery of the facemask.

This construction, while achieving the desired air-filtering function, undesirably hinders the ability of patients and other medical personnel to effectively communicate with the wearer of the conventional face mask. The mouth is hidden behind the filtering media and is not visible to others. Facial expressions and lip movements of the wearer, therefore, cannot be seen. This is particularly problematic if the wearer is trying to communicate with a hearing impaired person.

While some attempts have been made to remedy this deficiency in medical face mask construction, they have been largely unsuccessful, primarily due to the difficulty and high cost of manufacturing such face masks. In addition, most masks of the prior art that include a clear portion are of a rigid construction, provide inadequate face fit, and cannot be conveniently folded flat for storage and ease in dispensing.

Accordingly, there is a need for an air-filtering face mask that provides visibility of the wearer's mouth in order to facilitate communication of the wearer with others, and which is suitable for use by medical, dental, surgical, and other healthcare personnel.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to an air-filtering facemask that provides visibility of the wearer's mouth in order to facilitate communication of the wearer with others, and which is suitable for use by medical, dental, surgical, and other healthcare personnel.

In one aspect, the facemask of the present disclosure includes an air-filtering portion comprising an air-permeable filtering media; a see-through portion positioned and configured so that, in use, a mouth of a wearer is visible therethrough, wherein the see-through portion is formed from a transparent film covering a void in the air-permeable filtering media; and a layered portion on each opposing side of the see-through portion. The layered portion is formed from the transparent film extending across a length of the facemask, so that the film covers the void to form the see-through portion and is also layered on the air-permeable filtering media on each opposing side of the void. The transparent film is fixed along its periphery to the air-permeable filtering media.

In one aspect, each of the see-through portion and the transparent film has a vertical width that is greatest at a vertical midline of the facemask.

In further aspects, the transparent film is fixed at its outer side edges along each vertical peripheral edge of the facemask.

The transparent film is fixed, in aspects, to the air-permeable filtering media by one of ultrasonic welding, gluing, sewing, stapling, and combined heat and pressure.

In another aspect, the facemask includes an air-inhibiting seal along a periphery of the facemask.

The air-permeable filtering media in the layered portion, in aspects, includes a high-loft filtering material.

In additional aspects, the transparent film is formed from one or more of a polyester, polyethylene, polypropylene, polycarbonate, or plastic material.

In still further aspects, the air-filtering portion further comprises pleats formed in an upper and lower portion of the air-permeable filtering media. The lower portion is positioned below the transparent film. The pleats (in the lower portion) are configured to expand the mask vertically downward for fitting under the chin of a wearer and vertically upward (in the upper portion) for fitting over the nose and face.

The area of the air-permeable filtering media that forms the pleats in the lower portion of the air-filtering portion, in some aspects, is greater than an area of the see-through portion. The pleats in the facemask may be further configured such that the facemask may be folded flat.

The present disclosure is also directed to a method of manufacture of the facemask, including removing, e.g., by kiss-cutting, the air-permeable filtering media away to form the see-through portion, after layering and, in aspects, after fixing the film to the filtering media.

In one aspect, a method for manufacturing a facemask that includes a see-through portion and air-permeable filtering media, includes layering a transparent film onto a horizontal section of air-permeable filtering media configured to form a facemask; fixing at least a top and bottom peripheral edge of the transparent film to the horizontal section; and removing, after the layering step, the air-permeable filtering media from a portion of the horizontal section positioned to form a see-through portion of the facemask so that, in use, a mouth of a wearer is visible therethrough. The see-through portion is devoid of the air-permeable filtering media and covered by the transparent film. The method also includes sealing a periphery of the air-permeable filtering media forming the facemask. The periphery is configured to abut a wearer's face in use.

In additional aspects, layering the transparent film includes extending the transparent film across a length of the facemask to form the see-through portion and layered portions along either side of the see-through portion. Each of the layered portions includes the transparent film layered on the air-permeable filtering media.

In aspects, sealing the periphery includes fixing the transparent film to the horizontal section along each peripheral side edge of the facemask.

The removing step, in other aspects, includes kiss-cutting the filtering media out of the horizontal section and leaving the transparent film intact to form the see-through portion.

In further aspects, the method further includes shaping the top and bottom peripheral edge of the transparent film with a continuous zig-zag cut before the layering step. The zig-zag cut shapes the transparent film into a diamond-like shape for layering onto the horizontal section of air-permeable filtering media.

In additional aspects the method includes configuring pleats in the air-permeable filtering media above and below the horizontal section.

Each of the fixing and sealing step, in aspects, includes one of ultrasonic welding, gluing, sewing, stapling, and applying combined heat and pressure.

The present disclosure is also directed to a method for manufacturing a facemask, the facemask comprising an air-filtering portion including air-permeable filtering media and a see-through portion, which includes providing a first roll of air-permeable filtering media configured to form a facemask, and providing a second roll of transparent film. The method further includes layering the transparent film as it is fed from the second roll onto a section of the air-permeable filtering media as it is fed from the first roll; and fixing peripheral top and bottom edges of the transparent film to the section of the air-permeable filtering media. After the fixing step, for each length of the air-permeable media fed from the first roll that corresponds to a length of the facemask, air-permeable filtering media is removed from a portion of the section to form a see-through portion of the facemask that is positioned so that, in use, a mouth of a wearer is visible therethrough. The see-through portion of the facemask is devoid of air-permeable filtering media and covered by the transparent film.

In additional aspects, the method further includes configuring pleats, after the removing step, in the air-permeable filtering media positioned above and below the see-through portion of the facemask.

In aspects, the method further includes shaping the top and bottom peripheral edges of the transparent film with a continuous zig-zag cut before the layering step, the zig-zag cut shaping the transparent film fed from the second roll into a diamond-like shape for layering onto the length of the air-permeable filtering media, which is fed from the first roll, corresponding to the length of the facemask.

In further aspects, the method further includes sealing a periphery of the air-permeable filtering media forming the facemask, and separating the facemask from the first roll and the second roll.

The sealing step, in aspects, further includes fixing, as well as sealing, the transparent film to the air-filtering media along peripheral side edges of the facemask.

The present disclosure is also directed to a facemask including an air-filtering portion comprising an air-permeable filtering media; a see-through portion positioned and configured so that, in use, a mouth of a wearer is visible therethrough, wherein the see-through portion is formed from a transparent film covering a void in the air-permeable filtering media; and a layered portion on each opposing side of the see-through portion, the layered portion comprising the transparent film layered on the air-permeable filtering media, the transparent film extending across a length of the facemask to form the see-through portion and the layered portion on each opposing side thereof. The transparent film is fixed along its periphery to the air-permeable filtering media. The air-filtering portion further includes pleats formed in an upper and lower portion of the air-permeable filtering media positioned above and below the transparent film, respectively, the pleats being configured to expand the mask vertically downward for fitting under the chin of a wearer and vertically upward for fitting over the nose and face. The area of the air-permeable filtering media that forms the pleats in the lower portion of the air-filtering portion is greater than an area of the see-through portion.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the detailed description in conjunction with the accompanying drawings, which are briefly described below.

FIG. 6 is a flowchart representation of another embodiment of a method of the present disclosure.

Figure 1:
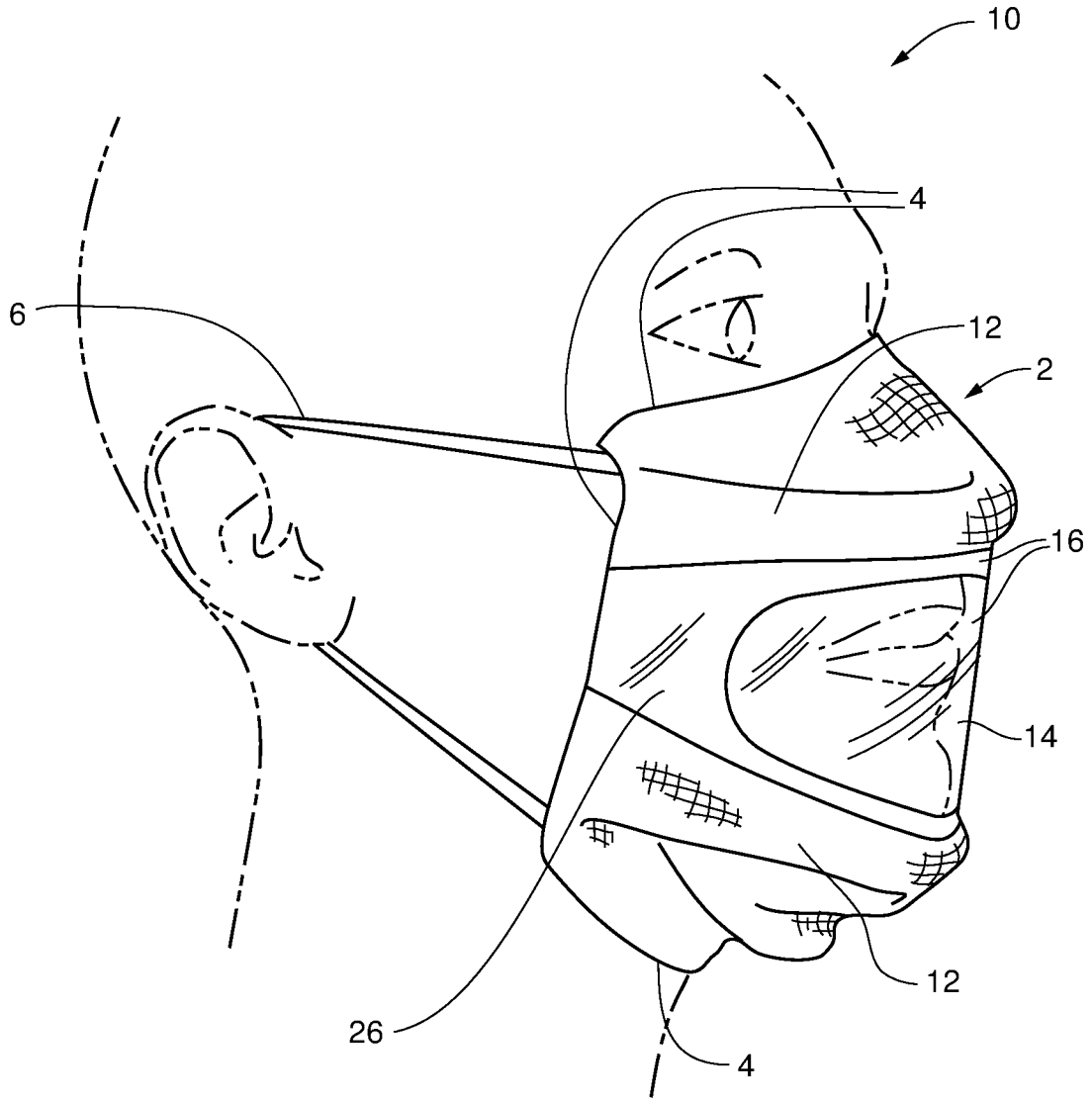
FIG. 1 is a pictorial representation of an embodiment of a facemask of the present disclosure in use by a wearer.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure of a medical facemask as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The present disclosure is directed to an air-filtering face mask that provides visibility of the wearer's mouth in order to facilitate communication of the wearer with others, and which is suitable for use by medical, surgical, dental, healthcare personnel and others. The present disclosure is also directed to methods for manufacturing the air-filtering face mask of the present disclosure.

The term "kiss-cutting" is used herein, as commonly known, to describe cutting an exposed layer or material without penetrating underlying layers or material. Kiss-cutting can be accomplished using any suitable methods known in the art, including, but not limited to, laser-cutting, or die-cutting (using, e.g., a rotary, blanking, or clicking die) to kiss-cut a portion of the contacted exposed layer(s) without disturbing the underlying material.

Figure 2:
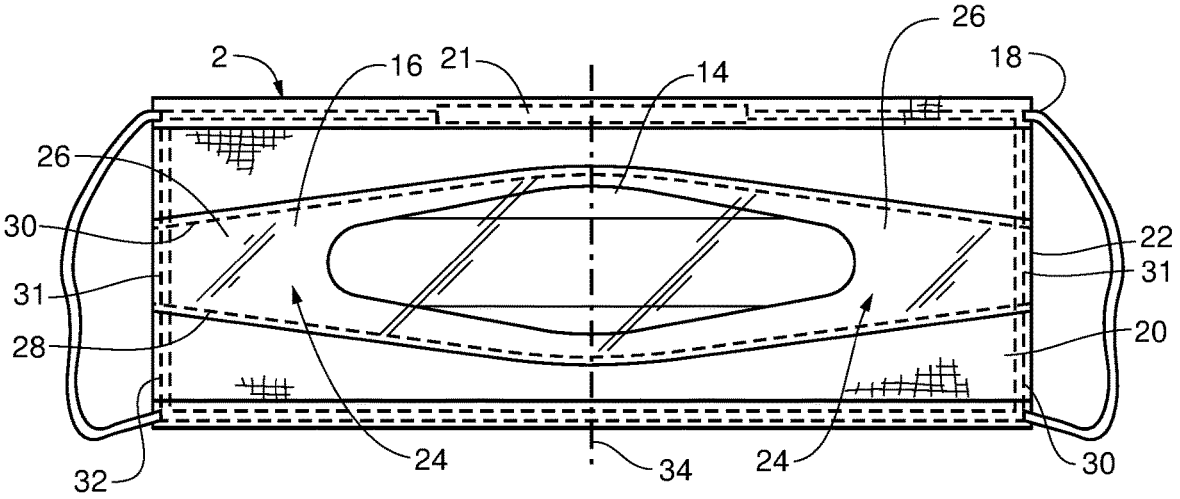
FIG. 2 is a front view of the embodiment of the facemask of FIG. 1 in a folded configuration for storage.
Figure 3:
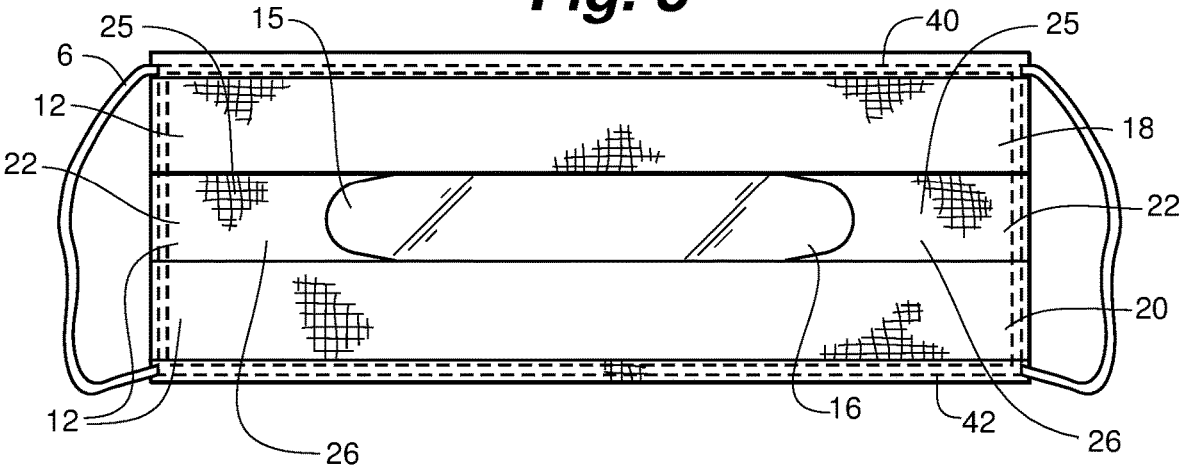
FIG. 3 is a back view of the embodiment of the facemask of FIG. 2 in the folded configuration, showing the side that faces the wearer in use.

Referring to FIGS. 1-3, an embodiment of a facemask 10 of the present disclosure includes a body 2 of air-permeable filtering media that is sealed around its periphery to form an air-inhibiting peripheral seal 4 configured to abut a wearer's face in use. The peripheral seal 4, in embodiments, may be elasticized for enhancing conformity of the periphery of the facemask 10 to a wearer's face. Attaching members 6, such as the earloops shown in FIG. 1, are attached to the body 2 and configured to properly position and retain the facemask 10 over the wearer's face. Air-filtering portions 12 for filtering contaminants from the breathable air of a wearer are formed from portions of the body 2 of the air-permeable filtering media as further described herein.

The facemask 10 further includes a see-through portion 14 that is devoid of the air-permeable filtering media, the void 15 being properly positioned and sized to provide visibility of a mouth of a wearer for improved communications with others. The see-through portion 14 is formed of a portion of the transparent film 16 that covers the void 15. The transparent film 16 is fixed at its periphery to the surrounding air-permeable filtering media. The transparent film 16 covering the void 15 provides both visibility of the wearer's mouth and an air-impermeable barrier to the flow of breathable air therethrough, thereby redirecting breathable air through the air-filtering portions 12 of the facemask 10.

The construction of the facemask of the present disclosure promotes a breathable air path for inhaled and exhaled air through air-filtering portions 12, while providing the see-through portion 14 over a wearer's mouth for enhanced communications. Because the transparent film 16 provides an air-impermeable barrier in front of a wearer's mouth, breathable air is directed (inhaled and exhaled) in an upward and downward path through air-filtering portions 12 to remove any air-borne contaminants.

Air-filtering portions 12 may include at least a single pleat in each of an upper section 18 and in a lower section 20 of the air-permeable filtering material or media to allow the facemask to be expanded vertically for fitting over the nose of a wearer, and under the chin of the wearer, respectively, for an improved face fit.

A bendable nose strip 21 may also be provided in the upper section 18 to conform and seal the mask over a nose and upper facial contours of a wearer.

Additional pleats are preferably provided, particularly in the lower section 20, to provide additional air-filtering media for improved breathability and filtration. In embodiments, the air-permeable filtering material that is added to form the additional pleats of the lower section 20 is in an amount (in square inches, e.g.) of at least equal to, and preferably greater than, the area of the see-through portion 14, and preferably greater than the entire area of the transparent film 16 layered on the air-permeable filtering material. The added air-permeable filtering material essentially replaces that which is lost, compared to a conventional facemask, due to the removal of air-permeable filtering material for forming the see-through portion, and alleviates one of the problems that the addition of a see-through portion presents: reduction in breathability. By increasing the amount of air-permeable filtering material in the lower section 20, the differential pressure across the facemask is lowered, thereby increasing the breathability of the mask and the comfort of the user. The added material, and additional pleats, in the lower section may also help to position the see-through portion with respect to the wearer's mouth. In addition, the added area of the filtering material enhances the filtration properties of the mask.

In embodiments, the amount of filtering material in the entire mask is greater than that provided in a conventional facemask (which has no see-through portion). Typically, such conventional masks, measured in an open position, or before any pleating of the air-permeable filtering media, measure about 7 inches in length (ear-to-ear) and about 7½ inches wide (vertical width). In embodiments of the facemask of the present disclosure, measured in the open position, or before pleating, and before forming the void in the filtering material for the see-through portion 14, the body 2 of air-permeable filtering material measures about 7 inches in length and at least about 8½ inches to about 9½ inches wide. This added material more than compensates for the area occupied by the transparent film, which is, in embodiments, between about 1¼ inches and about 2 inches high at its greatest width (preferably, along vertical midline 34), and preferably tapers down to about ½ inch at the outer edges of the facemask.

In addition, as further described below, as best shown in FIG. 3 and visible beneath the transparent film in the layered portions 26 of FIG. 1, there is additional air-permeable filtering material, referred to herein as an unattached portion 25, in each of the layered portions 26 that is left intact, with the transparent film overlaid on top of the air-permeable filtering material on the front side 50 of the mask, along opposing sides 24 of the central see-through portion 14, after forming the void 15. The air-permeable filtering media in the layered portions 26 rest against the wearer's face in use, reducing and, in embodiments, eliminating contact of the transparent film 16 with the wearer's face during use. Accordingly, in addition to enhancing breathability and filtration, the added filtering material in the layered portions 26 enhances the comfort of the wearer, and also reduces, and preferably eliminates, buildup of condensation on the transparent film 16 due to contact with the skin.

The transparent film 16 may be formed of any suitable transparent or semi-transparent material. In embodiments, the film 16 is a thin, flexible, single film, and can be easily attached by sewing, gluing, or welding, for example, to create a seal between the film 16 and the surrounding air-permeable filtering media without the need for any added sealing structures. As shown in FIGS. 2 and 3, the transparent film 16 construction in combination with the pleated configuration of the facemask advantageously allows the facemask 10 to be folded flat for storage purposes.

As best shown in FIGS. 2 and 3, the transparent film 16, in embodiments, is layered over both the void 15 forming the see-through portion 14 and over a horizontal section 22 of the body 2 of air-permeable filtering media surrounding the void 15, including over the filtering media along opposing sides 24 of the see-through portion 14. Layered portions 26 are thus formed in horizontal section 22 along opposing sides 24 of the see-through portion 14 that include the transparent film 16 overlaid on the air-permeable filtering media.

In embodiments, the transparent film 16 is secured along its periphery, for example, along a bottom peripheral edge 28, a top peripheral edge 30, and along its peripheral side edges 31, to the air-permeable filtering media. In embodiments, the transparent film 16 is secured only along its periphery, leaving the remaining air-permeable filtering media (i.e., excluding the peripheral edges 32) to form an unattached portion 25 in each of the layered portions 26 that is unattached to the transparent film 16.

Referring further to FIG. 1, when donned, the transparent film 16 is sufficiently rigid to flex along a continuous arc away from the wearer's face, while the peripheral seal 4 of the facemask and at least some of the air-permeable filtering media of the air-filtering portions 12 conforms to and contacts a wearer's face. In embodiments, when the facemask is donned, at least a portion of the air-permeable filtering media in layered portions 26 also preferably remains in contact with the wearer's face, while the transparent film 16 bends away from the face. The separation of the transparent film 16 from the wearer's face helps to prevent condensation buildup on the film 16. In addition, in the event any gaps occur between the wearer's face and the facemask 10 along the peripheral side edges 32, particularly due to the arcing and/or movement of the transparent film 16, the air-permeable filtering media in layered portions 26 provide a filtered air path therethrough, removing contaminants in breathable air that may pass through these gaps.

In further embodiments, the air-permeable filtering media in layered portions 26 may be configured of a high loft, compressible, air-permeable filtering media, such that if the peripheral seal provided along the side edges 32 of the layered portions 26 is breached, breathable air is filtered therethrough. Providing air-permeable filtering media in this high loft, compressible form, may prevent contaminated air that enters through gaps that occur in the peripheral seal 4 from reaching the user by compressing and expanding to conform to the contours of a wearer's face, particularly while the wearer is speaking and causing movement of the facial contours, thereby filtering breathable air, which may be contaminated, through the air-permeable filtering media in the layered portions 26 as well as through the air-filtering portions 12 before it reaches the wearer.

As best shown in FIGS. 1 and 2, the transparent film 16 of the present disclosure may be somewhat diamond-shaped, the film 16, in embodiments, being widest along a vertical midline 34 of the facemask 10, and tapering to narrower widths at the peripheral side edges 32 of the mask 10. Other shapes are also contemplated to fall within the scope of the disclosure for providing the functions and features described herein. For example, the transparent film 16 may be rectangular, or substantially rectangular, oval, and so on, preferably being greater in length (ear-to-ear) than in width.

The transparent film 16 may be fixed or bonded to the air-permeable filtering media by any appropriate means known in the art, such as by the use of adhesives, heat and pressure, ultrasonics, and so on.

In embodiments, the transparent film 16 extends to the side edges of the facemask so that the peripheral side edges 31 of the transparent film 16 are coincident with the side edges 32 of the facemask. In this configuration, the peripheral side edges of the transparent film 16 can advantageously be fixed to the facemask in the same step of sealing the periphery of the facemask, as described further herein.

The transparent film 16 is preferably constructed of a single layer of a thin, flexible, plastic sheet of material, which may also be an antifog and/or antiglare material, or optionally, the thin plastic sheet may be coated with an antifog and/or antiglare layer of film. In embodiments, the film 16 may be formed of one or more of a polyester, polyethylene, polypropylene, polycarbonate, or plastic material.

As shown in FIG. 1, earloops have been found to work particularly well as attaching members 6 for positioning, retaining, and properly fitting the facemask 10 of the present disclosure on the face of a wearer. However, any suitable attaching members 6 may be used, including, for example, headband(s), ties, or any other appropriate structures known in the art.

Suitable visibility of the mouth of a wearer to enhance communication with others is provided by proper sizing and juxtaposition of the see-through portion 14 relative to the other structural components of the facemask. In the embodiments shown, the see-through portion 14 is in the shape of an oval. However, any appropriate shape is contemplated to be within the scope of the disclosure.

In embodiments, see-through portion 14 is centrally located (in lengthwise, i.e., ear-to-ear direction) and extends across at least 50% of the length (ear-to-ear) of the body 2 of the facemask 10.

In additional embodiments, the see-through portion 14 extends across at least 60% of the length of the body 2 of the facemask 10, preferably extending across about 65% to about 75% of the length of the body 2 of the facemask 10. In still additional embodiments, the see-through portion 14 extends across about 70% of the length of the body 2 of the facemask 10.

In embodiments, the see-through portion 14 may extend vertically over at least about 15% of the height (also referred to herein as width) of the body 2 of the air-permeable filtering material before pleating. In other embodiments, the see-through portion 14 may extend vertically over between about 15% and about 20% of the height of the body 2 of the air-permeable filtering material before pleating.

The air-permeable filtering media may include any suitable material for use in a facemask to filter air-borne contaminants, and may include one or more nonwoven melt-blown and/or spunbond materials. In embodiments, the media may include one or more layers of material for filtering and/or absorbing unwanted particulates, bacteria, and other contaminants. In embodiments, the air-permeable filtering media may include an outer layer of a nonwoven, spunbond material, and an inner, face-side, layer of a nonwoven cellulose or other material that is more comfortable for contact with a wearer's face. Any number of intermediate layers may also be included.

Figure 4A:
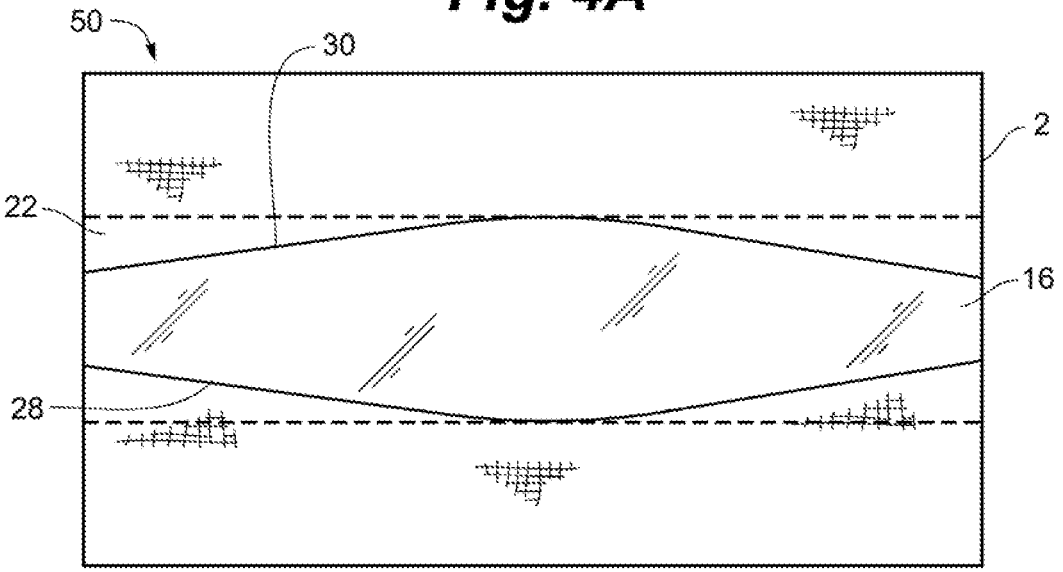
FIG. 4A is a front view of a partially completed facemask formed after steps of an embodiment of a method of the present disclosure.
Figure 4B:
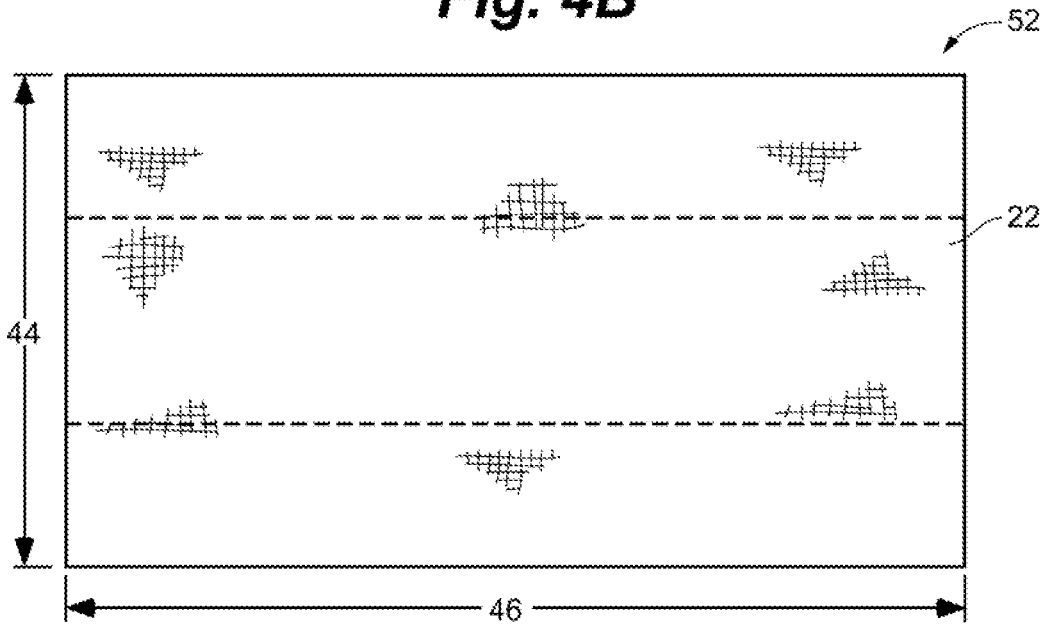
FIG. 4B is a back view of the partially completed facemask of FIG. 4A.
Figure 4C:
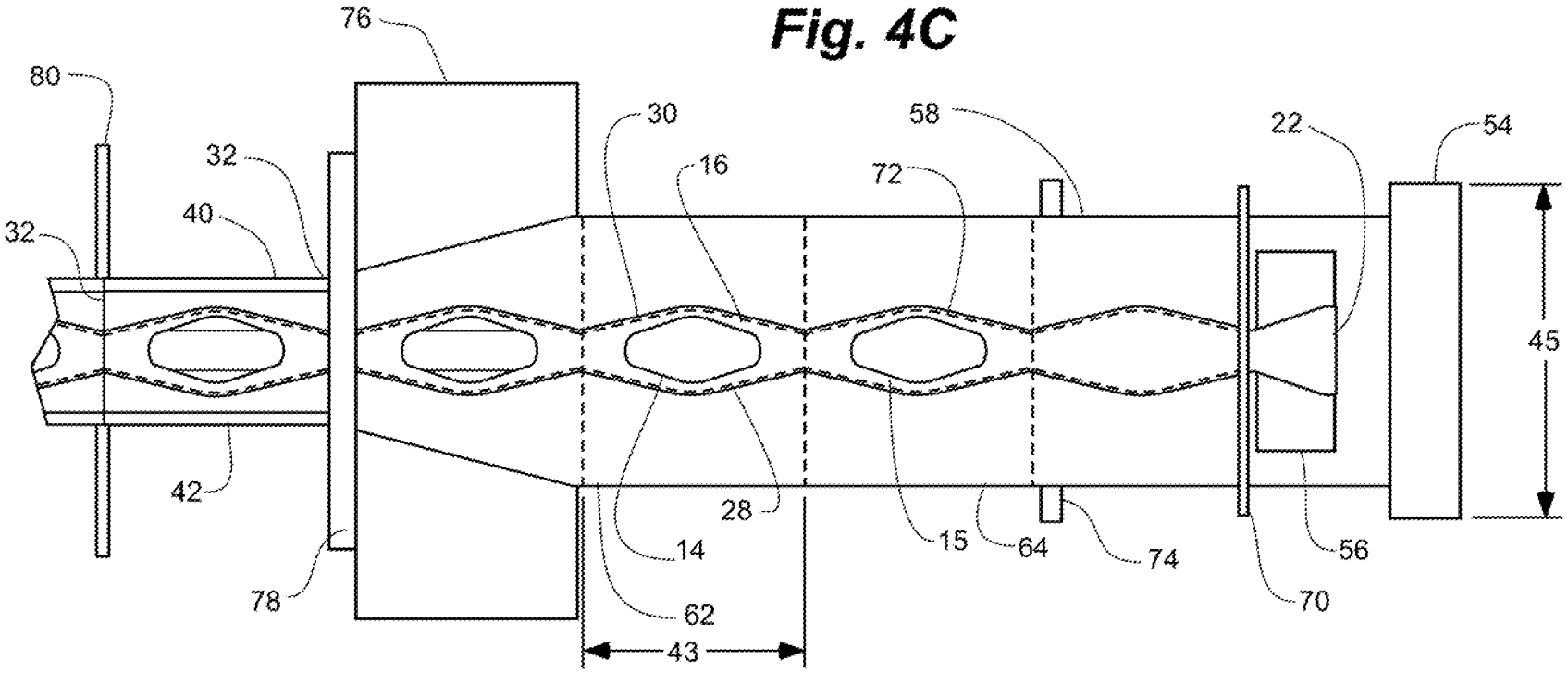
FIG. 4C is a schematic representation of part of a manufacturing process for performing the methods of the present disclosure.

The facemask of the present disclosure is well-suited for manufacturing in a cost-effective and efficient manner. Referring to FIGS. 4A-4C, as well as to FIG. 5, in an embodiment of a method 100 of the present disclosure for forming the facemask of the present disclosure, the transparent film 16 is layered onto the horizontal section 22 of the air-permeable filtering media, at 102. The front side 50 and the back side 52 (back side faces the wearer in use) of a partially formed facemask 10, before pleating, and after the layering step at 102, are shown in FIG. 4A and FIG. 4B, respectively. Because no material has been removed yet to form the void, the transparent film 16 is not yet visible from the back side 52 in FIG. 4B. After the layering 102 step, the see-through portion 14 of the facemask is formed, at 108, by removing air-permeable filtering media from a portion of the horizontal section 22 positioned to allow the mouth of a wearer of the facemask to be visible, when worn. This exposes the portion of the transparent film 16 in the back side 52 to form the see-through portion 14, as best seen in FIG. 3. It is noted, however, that FIG. 3 shows a finished pleated mask, so that an upper and lower portion of the oval cutout forming the see-through portion 14 (the oval cutout is clearly and fully seen in the front view of FIG. 2), is covered by the pleats in the upper 18 and lower sections 22 of the air-permeable filtering media.

At 104, at least top 30 and bottom peripheral edges 28 of the transparent film 16 are fixed to the horizontal section 22. The fixing step 104, in preferred embodiments, is performed prior to the removing step 108 to prevent slippage of the layers of air-permeable filtering media relative to the transparent film 16. In fixing step 104, the film 16 may be fixed to the air-permeable filtering media, for example, but without limitation, using one of ultrasonic welding, gluing, sewing, stapling, and applying combined heat and pressure.

The body 2 of the air-permeable filtering media is configured to form the facemask of the present disclosure having suitable dimensions and construction for covering a nose, mouth, face, and chin of a wearer. In embodiments, the body 2 of the air-permeable filtering media is configured with pleats, at 106, above 18 and below 20 the horizontal section 22. In embodiments, the pleats are configured at 106 after the removing step at 108.

As described herein, the amount of air-permeable filtering media, preferably configured with pleats, more than compensates for the area occupied by the see-through portion 14, and, in embodiments, more than compensates for the entire area covered by the transparent film. The pleated configuration of the body 2 and the single transparent film construction are also configured to provide a facemask that may be folded flat for storage, as shown in FIGS. 2 and 3, or expanded vertically upward and downward over a nose and under a chin of a wearer when donned.

In some embodiments, the air-filtering media is not configured with pleating, and the periphery of the mask is sealed at 110 without pleating the filtering media.

In other embodiments pleating of the facemask at 106 is performed before removing the air-permeable filtering media at 108. At 110, the periphery of the facemask is sealed.

In one embodiment, the method includes the ordered steps of first layering 102, then fixing 104, then next removing 108, and then, after the removing 108 step, configuring the media with pleats at 106, and finally, sealing the periphery of the facemask at 110.

In other embodiments, the pleats may be configured at 106 before the removing step at 108. One of skill in the art will appreciate that this ordering of steps (pleating 106 before the removing step at 108) is more easily performed in embodiments in which the see-through portion 14 is dimensioned and positioned such that it is entirely located between the folded edges of the pleats. In the embodiment of the mask shown in FIGS. 2 and 3, the see-through portion 14 is not entirely located between the folded edges of the pleats, so that the pleating at 106 may be more easily accomplished after the removing step at 108, and after the fixing step at 104, for the embodiment of FIGS. 2 and 3.

Referring again to FIGS. 4A and 4B, respectively, the front 50 and back 52 of the body of a partially formed facemask after completion of the layering step at 102 includes air-filtering portions 12, but no see-through portion. Referring again to FIG. 5, after the layering 102 and, in embodiments, after the fixing step 104, the see-through portion 14 of the facemask is formed, at 108, by removing air-permeable filtering media from a portion of the horizontal section 22 positioned to allow the mouth of a wearer of the facemask to be visible, when worn. In one embodiment, the see-through portion is formed by kiss-cutting a void 15 in the filtering media from the back 52 of the horizontal section 22, without disturbing the transparent film 16. In embodiments, kiss-cutting the void 15 may be accomplished by die-cutting, which may include using, for example, a rotary die, clicking die, or a blanking die. In other embodiments, kiss-cutting may be accomplished by laser-cutting.

Any suitable shape may be cut out of the air-permeable filtering media to form the see-through portion 14 of the present disclosure. In embodiments described herein, though not limited thereto, the void 15 cut in the horizontal section 22 may be in the shape of an oval. In other embodiments, it may be rectangular, or of any other suitable polygonal or other shape that is preferably of a horizontal length across the mask that is greater than its vertical width and that provides adequate visibility of the wearer's mouth.

The layering step 102, in embodiments, further includes extending the transparent film 16 across a length (along direction ear-to-ear) of the facemask, so that the layered portions 26 are formed along either side of the see-through portion 14, each of the layered portions comprising the transparent film 16 layered on air-permeable filtering media.

Figure 5:
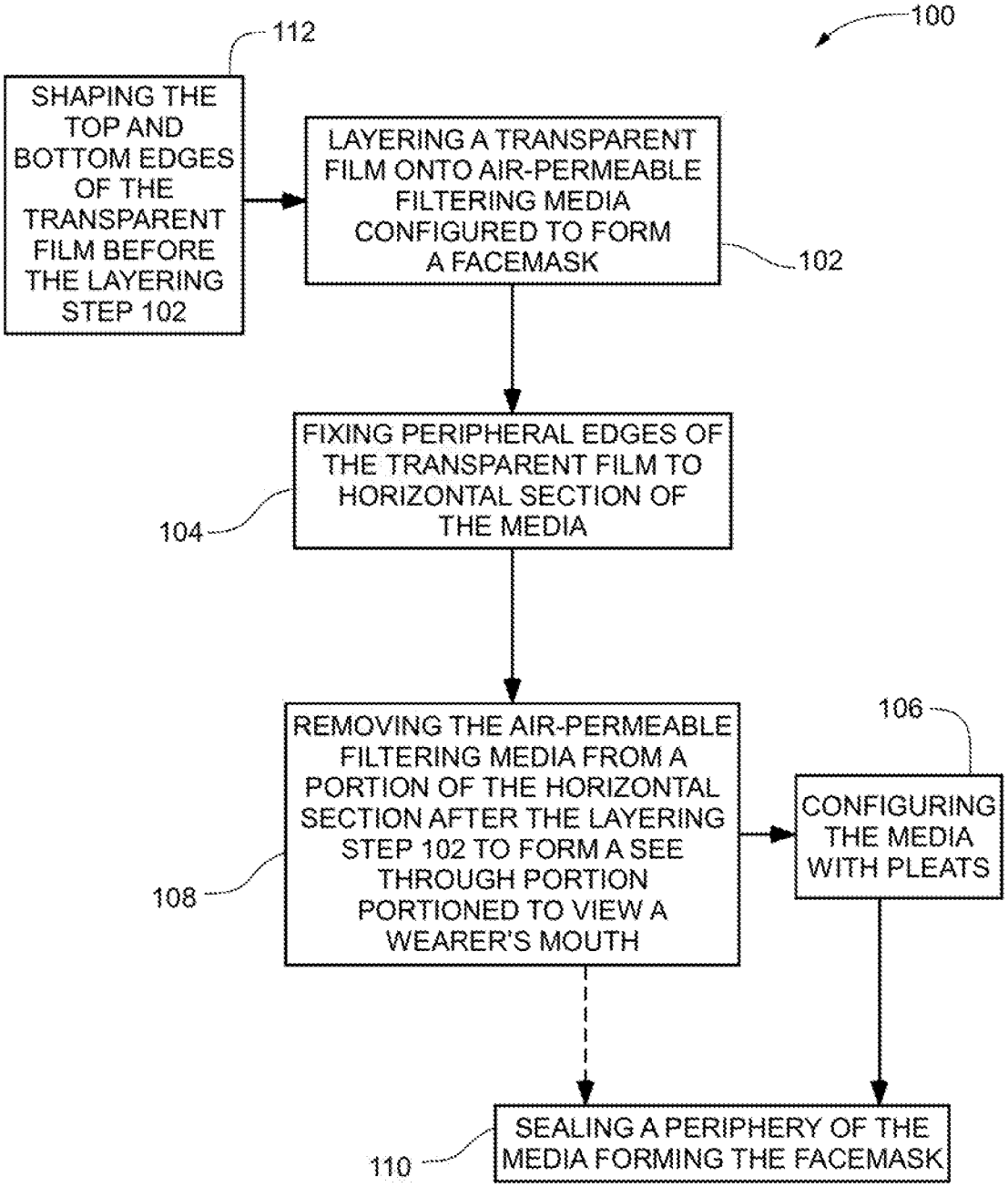
FIG. 5 is a flowchart representation of an embodiment of a method of the present disclosure.

Referring to FIG. 5, as well as FIGS. 1-3, embodiments of the method 100 further include sealing the periphery of the facemask to form the peripheral seal 4, at 110, the peripheral seal 4 being formed along the entire periphery, including along each peripheral side edge 32 and along the peripheral upper 40 and lower edge 42 of the air-permeable filtering media forming the facemask, to form the peripheral seal 4 for abutting the face of a wearer in use. In preferred embodiments, wherein the transparent film 16 extends the length of the facemask, the peripheral side edges 31 of the transparent thin film 16 can also be fixed to the peripheral side edges 32 of the facemask in the sealing step 110.

In various embodiments, the step of sealing the periphery of the facemask may include, without limitation, one or more of ultrasonic welding, gluing, sewing, stapling, and applying combined heat and pressure. The step of fixing, at 104, the peripheral edges of the transparent film 16 to the air-permeable filtering media may also include, without limitation, any one or more of ultrasonic welding, gluing, sewing, stapling, and applying combined heat and pressure. The fixing step 104 for fixing the transparent film 16 to the air-permeable filtering media along its edges, like the sealing step at 110 for sealing the periphery of the facemask, preferably creates a substantially air-tight seal between the materials.

Embodiments of the method may also include adding elastic to the periphery, as part of the sealing step 110 or as an additional step, to enhance the peripheral seal 4, by any method known in the art. The elasticizing of the seal may enhance the fit and provide an elasticized air-tight seal for abutting the face of a wearer during use.

In further embodiments, the method includes, at 112, shaping the top 30 and bottom peripheral edge 28 of the transparent film with a patterned cut, e.g., a zig-zag cut, before the layering step, at 102. For example, the zig-zag cut can be configured to shape the transparent film 16 into a diamond-like shape, like the embodiment shown in FIGS. 1-3. In other embodiments, for example, the transparent film 16 may be of rectangular or oval shape, or it may have a stepped edge pattern that allows the film 16 to be wider in the center of the mask and thinner toward the sides of the mask.

In other embodiments, the transparent film may be cut along the top and bottom edges to form any suitable shape and size for layering onto the horizontal section of air-permeable filtering media to form the see-through portion 14.

Although the removing step 108 is performed after the layering step 102 in the present disclosure, and, in embodiments, after the fixing step 104, in various embodiments, other steps may be performed in various orders. In embodiments, some of the steps may be performed concurrently. For example, the peripheral edges of the transparent film may be fixed, at 104, to the air-permeable filtering media concurrently with the layering step, at 102.

Referring to FIG. 4C as well as to FIG. 6, in embodiments, a method 120 may be implemented for efficient manufacture of a plurality of the facemask of the present disclosure, by providing, at 122, a first roll 54 of the air-permeable filtering media configured to form the body of the facemask, and providing, at 124, a second roll 56 of the material forming the transparent film 16. At 126, the transparent film 16 is layered as it is fed from the second roll 56 onto the section 22 of the air-permeable filtering media that will include the see-through portion 14, as the air-permeable filtering media 58 is fed from the first roll 54. The peripheral top 30 and bottom 28 edges of the transparent film 16 are then, in embodiments, fixed to the air-permeable filtering media, at 128, using any suitable fixing device 70 known in the art.

As shown, the sheet of transparent film that is fed from the second roll 56 may be shaped, at 130, before the layering step 126. In the embodiment shown in FIG. 4C, a continuous zig-zag cut may be formed along the top 30 and bottom 28 edges so that the transparent film fed from the second roll is shaped into a plurality of shapes, such as the diamond-like shapes shown, for layering onto the air-permeable filtering media 58 as it is fed from the first roll 54. The length 43 of each diamond-shaped film/filtering media layer corresponds to the length of a facemask. Accordingly, the layering step 126 can be efficiently performed for a plurality of facemasks as the film 16 and air-permeable filtering media 58 are fed from the rolls 56, 54. The fixing step 128, using a suitable fixing device 70, can likewise be easily performed in-line, and may be performed effectively concurrently with the layering step 126 to fix the top and bottom edges of the film 16, forming a seal 72 along the upper 30 and lower edges 28 of the film 16 as the film 16 is layered onto the section 22 of filtering media 58. The fixing device 70 may be any suitable device known in the art, such as an ultrasonic welder, adhesive applicator, sewing or stapling device, heat/pressure applicator, and so on.

After the layering 126, and preferably the fixing step 128 are applied, a portion 14 of the section 22 that is positioned so that, in use, a mouth of a wearer is visible therethrough, is removed, at 132, for each length 43 of the air-permeable media corresponding to the (unfinished) length 46 of a facemask (see FIG. 4B). The step of removing at 132 forms the void 15 for the see-through portion 14 of the facemask of the present disclosure, which includes the portion of the transparent film 16 covering the void 15. This step 132 may also be performed in-line after the layering 126 and preferably the fixing step 128 are completed for each length 43 corresponding to a facemask, by proper placement of the cutting device 74 as shown in FIG. 4C.

In embodiments, the removing step 132 includes, at 134, kiss-cutting the filtering media away from the air-permeable filtering media side (back side 52, for example) of the layer of film/filtering media using any appropriate cutting device 74 known in the art, such as a rotary die, blanking die, laser-cutting device, and so on. As shown in FIG. 4C, which shows a front view (see side 50, FIG. 4A) of a plurality of unfinished masks being manufactured, with the transparent film layered thereon, cutting device 74 is positioned for kiss-cutting the back side (see side 52, FIG. 4B) of the air-permeable filtering media without disturbing the transparent film 16.

In embodiments, the method 120 may further include configuring portions of the air-permeable filtering media with pleats, at 136. Referring to the embodiment shown in FIG. 4C, for example, a width 45 of the air-permeable filtering media 58 fed from the roll 54 corresponds to an unpleated (or open) width 44 of the facemask being manufactured. The pleating step, at 136, folds top 60 and bottom 62 unfinished edges of the facemasks to form the pleated sections of the facemask(s). In embodiments, the pleating step 136 is preferably performed after the removing step 132, and may further be performed in-line as a plurality of facemasks are formed, by proper placement of a pleating device 76 as shown in FIG. 4C. Any suitable pleating device 76 and method known in the art may be used for the pleating operation.

In other embodiments, portions of the air-permeable filtering media 58 may be pleated at 136 before the removing step at 132. For embodiments of a facemask in which the see-through portion 14 is entirely located between the folded edges of the pleats, for example, embodiments of the method that include pleating 136 before the removing step 132 may be accomplished with the pleating device 76 positioned before (upstream of) the cutting device 74.

In other embodiments, the air-permeable filtering media 58 fed from the roll 54 may be already configured with pleats, so that the pleating step 136 is performed before the layering, fixing and removing steps.

Referring still to FIG. 6, the method of the present disclosure further includes sealing the air-permeable filtering media along each periphery of each facemask, at 138. The periphery is preferably sealed to form the peripheral seal 4 for each facemask after configuring the pleats, at 136, to form the peripheral seal 4 using any suitable sealing device 78. The sealing device 78, like the fixing device 70, may be any suitable device known in the art, such as an ultrasonic welder, adhesive applicator, sewing or stapling device, heat/pressure applicator, and so on.

The sealing step 138 may include sealing the top and bottom edges of the pleated media in continuous fashion and also includes sealing along each of the edges perpendicular to the direction in which the rolls are fed (in the direction of width 40) to form the peripheral side edges 32 (separated by the length of each facemask) of the facemasks. As shown in the finished masks of FIGS. 2 and 3 and illustrated in FIG. 4C, in embodiments, the step of sealing 138 also includes concurrently fixing the side edges 31 of the transparent film to the peripheral side edges 32 of the facemask.

Referring to FIG. 4C, in embodiments of the method of the present disclosure, each of the finished facemasks, after the sealing step at 138, is separated, at 140, from the rolls 54, 56, and from the remainder of the unfinished facemasks being processed, by cutting along each one of the edges 32. The separating step may be accomplished by any suitable cutting device 80 appropriately positioned after the sealing device 78, as shown, for example, by FIG. 4C.

In various embodiments, any of the sealing and fixing steps can be performed by any one or more of, but is not limited to, ultrasonic welding, gluing, sewing, stapling, and applying combined beat and pressure.

The methods of the present disclosure can further include attaching members 6, such as earloops, to the facemask in accordance with any suitable method known in the art.

It should be noted that, although the method of the present disclosure includes performing the removing step 132 after the layering step 126, in embodiments, other steps do not need to be performed in any particular order. Certain steps of the present disclosure may also be performed concurrently.

While particular embodiments of the present disclosure have been particularly shown and described with reference to specific embodiments, it should be apparent to those skilled in the art that the foregoing is illustrative only and not limiting, having been presented by way of example only. It is to be understood that the disclosed embodiments are merely examples of the disclosure, which may be embodied in various forms and detail without departing from the spirit and scope of the disclosure. Therefore, specific structural and functional details disclosed herein are not to be interpreted as limiting. Numerous other embodiments of the facemask of the present disclosure may fall within the scope of the accompanying claims and equivalents thereto.

What is claimed is:

1. A facemask comprising:

an air-filtering portion comprising an air-permeable filtering media;

a see-through portion positioned and configured so that, in use, a mouth of a wearer is visible therethrough, wherein the see-through portion is formed from a transparent film covering a void in the air-permeable filtering media, the void being unobstructed in use by the air-filtering portion, and wherein the transparent film is air-impermeable, the see-through portion providing a barrier to the flow of breathable air therethrough; and a layered portion on each opposing side of the void in the see-through portion, the layered portion comprising the transparent film layered on the air-permeable filtering media, the transparent film extending beyond the void lengthwise across the facemask to form the see-through portion and the layered portion on each opposing side of the see-through portion, wherein the transparent film is fixed along its periphery to the air-permeable filtering media, wherein the facemask is configured to fold flat, and wherein the transparent film is configured to flex along a continuous arc away from a wearer's face in the facemask when donned and in use, whereas the air-permeable filtering media in the layered portion is configured such that at least a portion of the air-filtering media beneath the transparent film in the layered portion conforms to and contacts the wearer's face in use, wherein the air-permeable filtering media in the layered portion prevents contact of the transparent film with the wearer's face and is configured to filter breathable air that passes through gaps formed between the wearer's face and each peripheral side edge of the layered portion of the facemask in use.

2. The facemask of claim 1, wherein each of the see-through portion and the transparent film has a vertical width that is greatest at a vertical midline of the facemask.

3. The facemask of claim 1, wherein each peripheral side edge of the periphery of the transparent film is fixed along each vertical peripheral edge of the facemask.

4. The facemask of claim 1, wherein the transparent film is fixed to the air-permeable filtering media by one of ultrasonic welding, gluing, sewing, stapling, and combined heat and pressure.

5. The facemask of claim 1, further comprising an air-inhibiting seal along a periphery of the facemask.

6. The facemask of claim 1, wherein the air-permeable filtering media in the layered portion includes a high-loft filtering material.

7. The facemask of claim 1, wherein the transparent film is formed from one or more of a polyester, polyethylene, polypropylene, polycarbonate, or plastic material.

8. The facemask of claim 1, wherein the air-filtering portion further comprises pleats formed in an upper and lower portion of the air-permeable filtering media positioned above and below the transparent film, respectively, the pleats being configured to expand the mask vertically downward for fitting under the chin of a wearer and vertically upward for fitting over the nose and face.

9. The facemask of claim 8, wherein the area of the air-permeable filtering media that forms the pleats in the lower portion of the air-filtering portion is greater than an area of the see-through portion, the lower portion being positioned below the transparent film.

10. The facemask of claim 1, wherein the air-permeable filtering media includes an unattached portion surrounding the void and interior of the periphery of the transparent film in the layered portion, the unattached portion being unattached to the transparent film.

11. The facemask of claim 1, wherein a length of the see-through portion is 65% to 75% of a full length of the facemask and the transparent film extends the full length of the facemask.

12. A method for manufacturing a facemask, the facemask comprising an air-filtering portion including air-permeable filtering media and a see-through portion that is air-impermeable, the method comprising:

layering a transparent film onto a horizontal section of air-permeable filtering media configured to form a facemask, the transparent film being air-impermeable;

fixing at least a top and bottom peripheral edge of the transparent film to the horizontal section;

removing, after the layering step, the air-permeable filtering media from a portion of the horizontal section to form a see-through portion of the facemask that is devoid of the air-permeable filtering media and covered by the transparent film, the see-through portion being positioned so that, in use, a mouth of a wearer is visible therethrough; and sealing a periphery of the air-permeable filtering media forming the facemask, the periphery configured to abut a wearer's face in use, wherein the facemask is configured to fold flat, and wherein the transparent film is configured to flex along a continuous arc away from the wearer's face in the facemask when donned and in use, whereas the air-permeable filtering media in the layered portion is configured such that at least a portion of the air-filtering media beneath the transparent film in the layered portion conforms to and contacts the wearer's face in use, wherein the air-permeable filtering media in the layered portion prevents contact of the transparent film with the wearer's face and is configured to filter breathable air that passes through gaps formed between the wearer's face and each peripheral side edge of the layered portion of the facemask in use.

13. The method of claim 12, wherein layering the transparent film includes extending the transparent film across a length of the facemask to form the see-through portion and layered portions along either side of the see-through portion, each of the layered portions comprising the transparent film layered on the air-permeable filtering media.

14. The method of claim 13, wherein sealing the periphery includes fixing the transparent film to the horizontal section along each peripheral side edge of the facemask.

15. The method of claim 12, wherein the removing step includes kiss-cutting the filtering media out of the horizontal section and leaving the transparent film intact to form the see-through portion.

16. The method of claim 12, further comprising shaping the top and bottom peripheral edge of the transparent film with a continuous zig-zag cut before the layering step, the zig-zag cut shaping the transparent film into a diamond-like shape for layering onto the horizontal section of air-permeable filtering media.

17. The method of claim 12, further comprising configuring pleats in the air-permeable filtering media above and below the horizontal section.

18. A method for manufacturing a facemask, the facemask comprising an air-filtering portion including air-permeable filtering media and a see-through portion that is air-impermeable, the method comprising:

providing a first roll of air-permeable filtering media configured to form a facemask;

providing a second roll of transparent film, the transparent film being air-impermeable;

layering the transparent film as it is fed from the second roll onto a section of the air-permeable filtering media as it is fed from the first roll;

fixing peripheral top and bottom edges of the transparent film to the section of the air-permeable filtering media; and removing, after the fixing step, and for a length of the air-permeable media fed from the first roll that corresponds to a length of the facemask, a portion of the air-permeable filtering media from the section, the portion removed being positioned to form a see-through portion of the facemask so that, in use, a mouth of a wearer is visible therethrough, the see-through portion of the facemask being devoid of air-permeable filtering media and covered by the transparent film, wherein the facemask is configured to fold flat, and wherein the transparent film is configured to flex along a continuous arc away from a wearer's face in the facemask when donned and in use, whereas the air-permeable filtering media in the layered portion is configured such that at least a portion of the air-filtering media beneath the transparent film in the layered portion conforms to and contacts the wearer's face in use, wherein the air-permeable filtering media in the layered portion prevents contact of the transparent film with the wearer's face and is configured to filter breathable air that passes through gaps formed between the wearer's face and each peripheral side edge of the layered portion of the facemask in use.

19. The method of claim 18, further comprising configuring pleats, after the removing step, in the air-permeable filtering media positioned above and below the see-through portion of the facemask.

20. The method of claim 18, further comprising shaping the top and bottom peripheral edges of the transparent film with a continuous zig-zag cut before the layering step, the zig-zag cut shaping the transparent film fed from the second roll into a diamond-like shape for layering onto the length of the air-permeable filtering media fed from the first roll corresponding to the length of the facemask.

21. The method of claim 18, the method further comprising sealing a periphery of the air-permeable filtering media forming the facemask, and separating the facemask from the first roll and the second roll.

22. The method of claim 21, wherein sealing further includes fixing the transparent film to the air-filtering media along peripheral side edges of the facemask.

* * * * *